US007648024B2

(12) United States Patent
Mitten et al.

(10) Patent No.: US 7,648,024 B2
(45) Date of Patent: Jan. 19, 2010

(54) POCKET-SIZED, HAND-HELD CONTAINER FOR CONSUMER ITEMS HAVING A RECEPTACLE FOR USED PRODUCT, SEALED TRAY, AND THUMB RIDGE ON LID

(75) Inventors: Robert T. Mitten, Glen Allen, VA (US); Xuan M. Pham, Glen Allen, VA (US); Yvonne DeVerry, Midlothian, VA (US); Sven Bergmann, Richmond, VA (US); Stephen J. Bellamah, Midlothian, VA (US); Stephen Getsy, Bridgeville, PA (US)

(73) Assignee: Phillip Morris USA Inc., Richmond, VA (US)

( * ) Notice: Subject to any disclaimer, the term of this patent is extended or adjusted under 35 U.S.C. 154(b) by 0 days.

(21) Appl. No.: 12/153,891

(22) Filed: May 27, 2008

(65) Prior Publication Data

US 2009/0057173 A1 Mar. 5, 2009

Related U.S. Application Data

(60) Provisional application No. 60/924,714, filed on May 29, 2007.

(51) Int. Cl.
*B65D 85/10* (2006.01)

(52) U.S. Cl. ..... 206/236; 206/37; 206/267; 220/345.1; 220/345.4

(58) Field of Classification Search ..... 206/37, 206/38, 236, 237, 242, 259, 264, 267, 496; 220/252, 315, 324, 345.1–345.4
See application file for complete search history.

(56) References Cited

U.S. PATENT DOCUMENTS 189,604 A 4/1877 Cauhapé
224,096 A 2/1880 Lorillard, Jr.
1,163,773 A 12/1915 Ross
1,906,742 A 5/1933 Coulapides
1,935,840 A * 11/1933 Fitzgerald ..... 206/267

(Continued)

FOREIGN PATENT DOCUMENTS

CH 529013 10/1972

(Continued)

OTHER PUBLICATIONS

International Search Report and Written Opinion dated Aug. 16, 2007 for PCT/IB2006/003333.

(Continued)

*Primary Examiner*—Luan K Bui
(74) *Attorney, Agent, or Firm*—Buchanan Ingersoll & Rooney PC

(57) ABSTRACT

Provided is a pocket-sized, hand-held container including a receptacle at least partially housed in an outer housing and a tray, contained within the outer housing and positioned around the receptacle. Preferably, the tray is sealed with a membrane. The receptacle is used to contain spent product. Preferably, the outer housing includes an upper housing and a lower housing. A lid in the upper housing slides open to reveal an openable window in the membrane. In an embodiment, at least one thumb ridge is located on the lid to facilitate opening and closing of the lid.

17 Claims, 5 Drawing Sheets

U.S. PATENT DOCUMENTS 2,037,912 A 4/1936 Lisner
2,050,079 A 8/1936 Zell
2,076,353 A 4/1937 Samstag
2,099,122 A 11/1937 Kreisler
2,281,663 A * 5/1942 Bohr ..... 206/237
2,471,963 A * 5/1949 Kaplan ..... 206/236
3,007,623 A 11/1961 Clemens
3,039,671 A 6/1962 Chiamardas
3,112,029 A 11/1963 Davey
3,226,010 A 12/1965 Rogers, Jr.
3,325,000 A 6/1967 Edwards
3,367,551 A 2/1968 Wheeler
3,711,011 A 1/1973 Kugler
3,987,891 A 10/1976 Horvath
4,076,117 A 2/1978 Wisdom et al.
4,113,098 A 9/1978 Howard
4,126,224 A 11/1978 Laauwe et al.
4,174,034 A 11/1979 Hoo
4,364,488 A 12/1982 Anjou
4,485,915 A 12/1984 Berghahn
4,561,544 A 12/1985 Reeve
4,589,430 A 5/1986 Sussman
4,709,399 A 11/1987 Sanders
4,723,301 A 2/1988 Chang
4,727,890 A 3/1988 Vincent
4,741,441 A 5/1988 Keffeler
4,819,829 A 4/1989 Rosten et al.
4,840,270 A 6/1989 Caputo et al.
4,844,284 A 7/1989 Drozd et al.
4,880,712 A 11/1989 Gordecki
4,932,547 A 6/1990 Rodriguez
4,941,570 A * 7/1990 Kruger et al. ..... 206/267
5,074,412 A 12/1991 White
5,080,222 A 1/1992 McNary
5,082,137 A 1/1992 Weinstein
5,092,354 A 3/1992 Pacelli, Jr.
5,135,822 A 8/1992 Okamoto
5,145,091 A 9/1992 Meyers
5,180,056 A 1/1993 Adams et al.
5,201,413 A 4/1993 DeBlasio et al.
5,205,403 A 4/1993 DeBlasio et al.
5,275,291 A 1/1994 Sledge
D352,895 S 11/1994 van Loo
5,373,862 A 12/1994 Blachut
5,531,325 A 7/1996 Deflander et al.
5,605,167 A 2/1997 Montoli
5,630,503 A 5/1997 Rhodes et al.
D384,538 S 10/1997 Bosworth
5,711,423 A * 1/1998 Fuller, Jr. ..... 206/267
5,799,781 A 9/1998 Arthur
5,848,595 A 12/1998 Arthur
D406,487 S 3/1999 Attar et al.
D407,972 S 4/1999 Hilton
5,899,326 A 5/1999 Benhamou et al.
5,908,246 A 6/1999 Arimura et al.
5,938,013 A 8/1999 Palumbo et al.
5,996,797 A 12/1999 Flaig
6,050,449 A 4/2000 Kanj
6,076,679 A * 6/2000 Yuhara et al. ..... 206/581
6,113,271 A 9/2000 Scott et al.
6,199,695 B1 3/2001 Takeo
6,237,776 B1 5/2001 Mogil
6,244,434 B1 6/2001 Brooks
D446,718 S 8/2001 Anderson
D451,799 S 12/2001 Berger et al.
6,341,693 B2 1/2002 Konno et al.
6,341,710 B1 1/2002 Danielson et al.
D460,352 S 7/2002 Bried
D465,729 S 11/2002 Nishimura
D494,466 S 8/2004 Devine
D497,246 S 10/2004 Darst
D497,803 S 11/2004 Nichols et al.
6,823,989 B2 11/2004 Wilder et al.
6,929,400 B2 8/2005 Razeti et al.
6,971,521 B2 12/2005 Pinyot
6,976,577 B2 12/2005 Devine
7,114,504 B2 10/2006 Fox
7,114,619 B2 10/2006 Ellis et al.
7,124,883 B1 10/2006 Thomas et al.
7,147,127 B2 12/2006 Lepke et al.
7,584,843 B2 * 9/2009 Kutsch et al. ..... 206/267
2002/0000389 A1 1/2002 Garcia
2004/0056035 A1 3/2004 Baker et al.
2004/0173613 A1 9/2004 Schroeder et al.
2005/0117819 A1 6/2005 Kingsford et al.
2005/0207680 A1 9/2005 Schumacher et al.
2006/0283721 A1 12/2006 Kutsch et al.
2007/0012711 A1 1/2007 Kutsch et al.
2008/0202955 A1 8/2008 Kutsch et al.

FOREIGN PATENT DOCUMENTS

DE 2544743 4/1977
FR 1457910 1/1966
GB 2174075 10/1986
JP 11206443 8/1999
NL 6401066 8/1965
WO WO 03/094823 11/2003

OTHER PUBLICATIONS

International Search Report and Written Opinion dated May 10, 2007 for PCT/IB2006/003253.
Partial International Search Report dated May 3, 2007 for PCT/IB2006/003333.
International Search Report and Written Opinion dated Feb. 9, 2007 for PCT/IB2006/002909.

* cited by examiner

FIG. 5
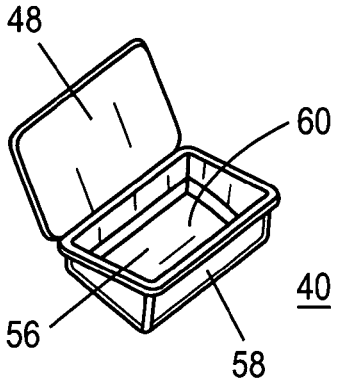
FIG. 6
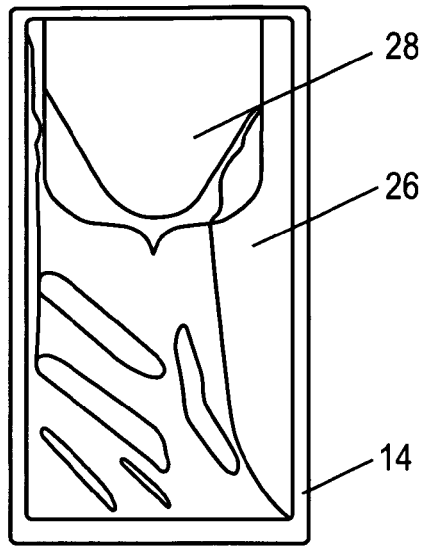
FIG. 7
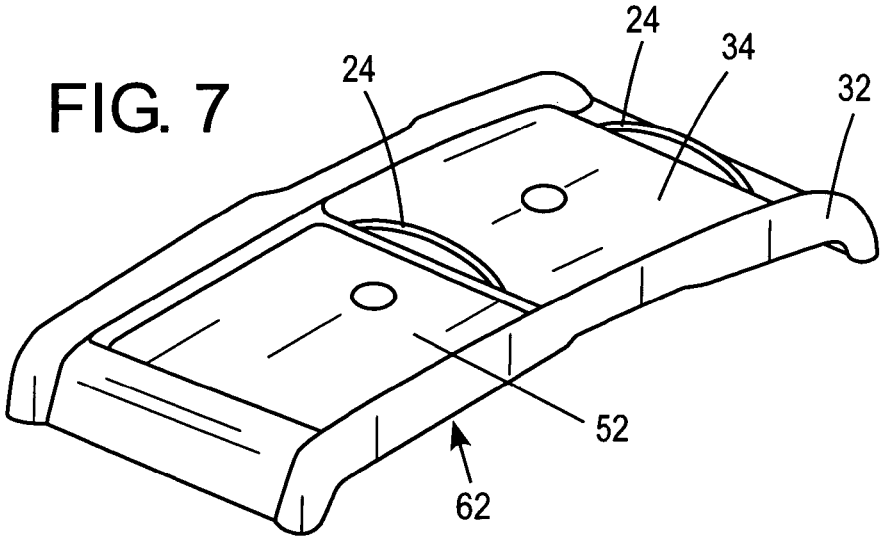
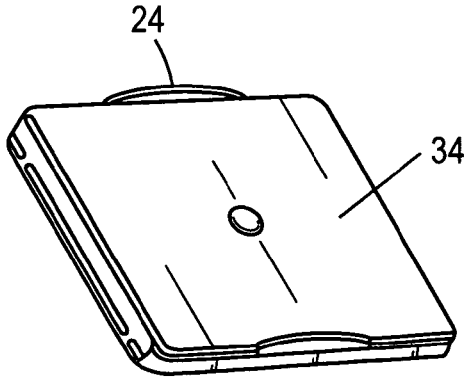
FIG. 8

POCKET-SIZED, HAND-HELD CONTAINER FOR CONSUMER ITEMS HAVING A RECEPTACLE FOR USED PRODUCT, SEALED TRAY, AND THUMB RIDGE ON LID

CROSS REFERENCE TO RELATED APPLICATION

This application claims priority under 35 U.S.C. §119(e) to U.S. provisional Application No. 60/924,714, filed on May 29, 2007, the entire content of which is incorporated herein by reference.

SUMMARY

Provided is a container adapted to hold a number of consumer items, and in particular a pocket-size container that can be held and opened by one hand of a consumer to expose the items therein. The container includes a receptacle to store spent product.

BRIEF DESCRIPTION OF THE DRAWINGS

FIG. 5 is a perspective view of a removable receptacle for spent product.

FIG. 6 is an illustration of a tray having a membrane and pull tab for maintaining freshness of smokeless tobacco products stored in the tray.

FIG. 7 is an illustration of the upper housing of a smokeless tobacco container including a lid with thumb ridges.

FIG. 8 is an illustration of a lid having thumb ridges.

DETAILED DESCRIPTION

Figure 1:
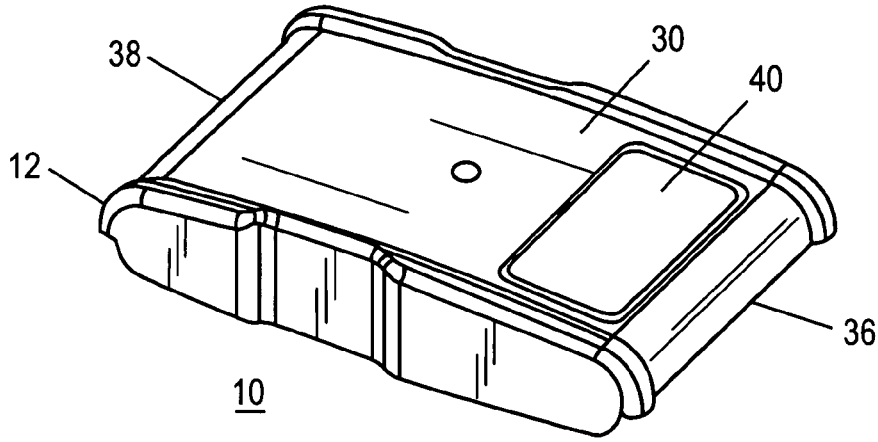
FIG. 1 is a perspective view of the lower housing of a container for consumer items, such as smokeless tobacco, having a receptacle for spent product.

Shown in the accompanying drawings is a pocket-size container capable of being held in one hand of a consumer and opened by a finger or thumb of that hand. The container, which is preferably formed of about three to about six pieces, preferably contains a tray that is sealed with a membrane. An openable window on the membrane situated behind an access opening of the container facilitates access to the contained items. In a preferred embodiment, the container includes a receptacle for storing used products. Preferably, the container also includes a lid having thumb ridges thereon to facilitate opening and closing of the lid.

In a preferred embodiment, the pocket-size container includes an outer housing having an upper housing and a lower housing. A tray is received within the outer housing. Preferably, the tray includes a cavity formed by a bottom wall and sidewalls of the tray. In a preferred embodiment, the container also includes a receptacle located at least partially within said outer housing. Preferably, the receptacle includes a lid and a compartment formed by a bottom wall and sidewalls of the receptacle. In an embodiment, the receptacle includes a compartment formed by a recessed surface in the lower housing enclosed by a lid.

In a preferred embodiment, the tray holds a plurality of smokeless tobacco products and is hermetically sealed by a membrane to maintain freshness. Preferably, the membrane includes a pull tab that is pulled to open the membrane. In an embodiment, the membrane is a poly-laminated membrane.

In a preferred embodiment, the upper housing of the outer housing includes a lid. Preferably, the lid slides open to reveal an openable window of the membrane. The openable window includes a pull tab that is pulled to open the window and access the enclosed product. In an embodiment, the lid includes at least one raised thumb ridge to facilitate opening and closing of the lid. In use, the upper housing forms a front of the container and the lower housing forms the back of the container.

Preferably, the lower housing includes a recess for housing said receptacle. In an embodiment, the receptacle is removable from the pocket-size container. In a preferred embodiment, the receptacle is integrally formed with the lower housing such that a recess therein forms the walls and sidewall of the receptacle.

In a preferred embodiment, the pocket-size container is made of rigid plastic. Preferably, the pocket-size container is injection molded of a material selected from the group consisting of polypropylene, polyethylene, polystyrene, nylon, polysulfone, polyester, polyurethane, and combinations thereof.

Also provided is a method of packaging smokeless tobacco products. Preferably, the method includes filling a tray with smokeless tobacco products and hermetically sealing the tray with a membrane. The tray is then inserted into a lower housing. If the receptacle is not molded as part of the lower housing, the receptacle is also at least partially inserted into the lower housing. The upper housing is positioned over the lower housing so as to line up pins in the upper housing with pin holes in the lower housing, and the pins are inserted into the pin holes to form a smokeless tobacco container.

FIG. 1 is a perspective view of a pocket-size container 10 for smokeless tobacco products. The container 10 includes an outer housing 12 having an upper housing 32 (shown in FIG. 7) that is designed to fit over and around the tray 14 (shown in FIG. 6) and engage with the lower housing 30 to form the outer housing 12 (shown in FIG. 9). Preferably, the container 10 includes a first lid 34 (shown in FIG. 8), which allows access to the unused product stored in the tray 14 and a receptacle 40 for storing spent product. In a preferred embodiment, the receptacle 40 is located adjacent a first end 36 of the container 10 and is accessible via a second lid 48 in lower housing 30. In another embodiment, the receptacle 40 may be in a central location on the container or accessible via a second lid in the upper housing.

Figure 10:
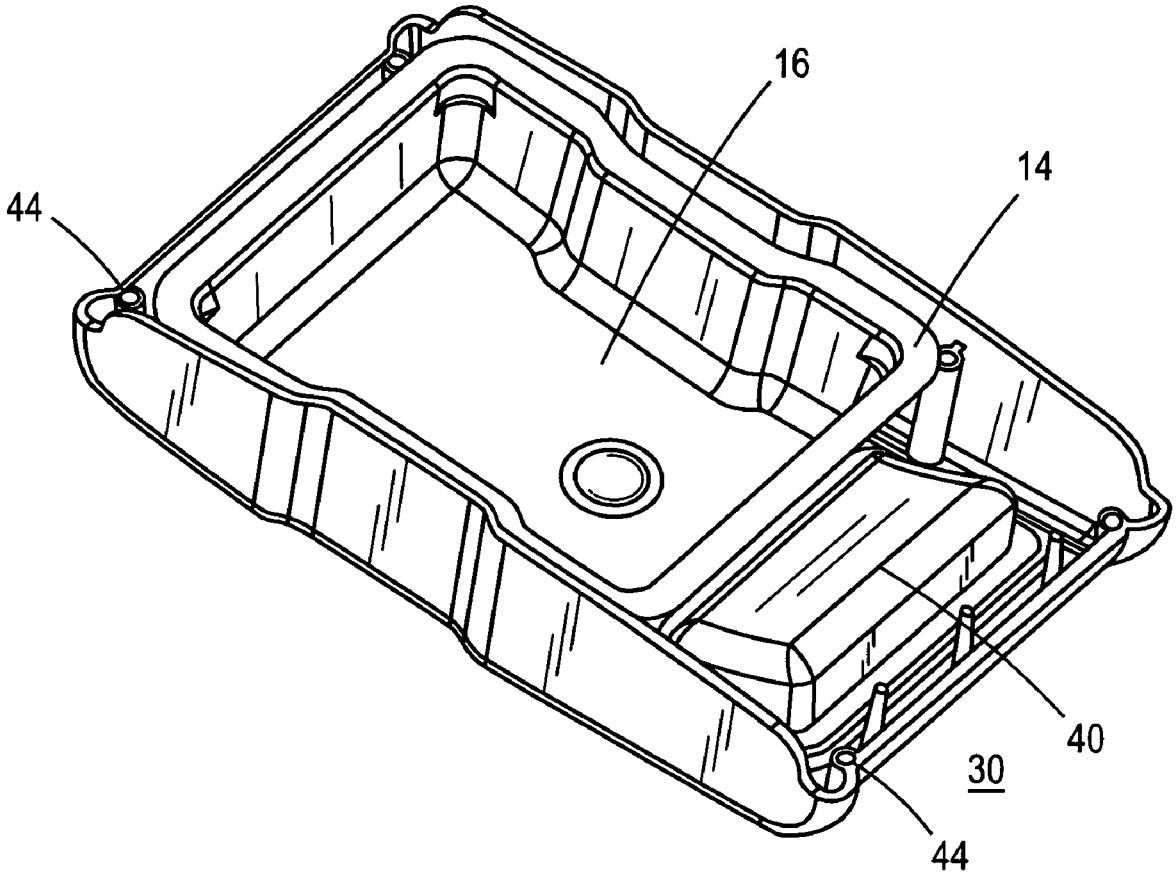
FIG. 10 is an illustration of a preferred embodiment of the lower housing.

In a preferred embodiment, the tray 14 is shaped to accommodate the receptacle within the outer housing 12. The tray 14 may be shortened on one end to make room for the receptacle 40, as shown in FIG. 10. Alternatively, the tray 14 may be contoured to fit around the receptacle 40.

Figure 2:
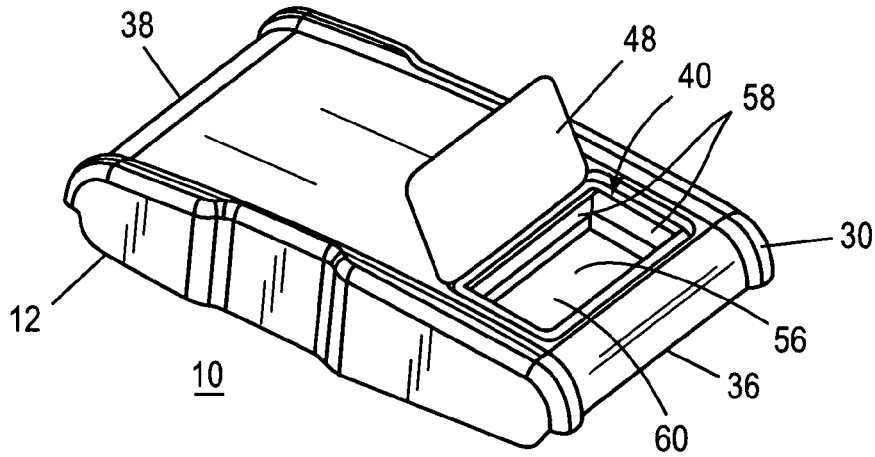
FIG. 2 is a perspective view of the lower housing of the container of FIG. 1 having an open receptacle for spent product.

In an embodiment, as seen in FIG. 2, the receptacle 40 has a lid 48 that opens to reveal a receptacle cavity 56 defined by sidewalls 58 and a bottom 60. Preferably, the receptacle 40 is sized and configured to hold at least one spent tobacco product. Preferably, the receptacle 40 holds between 1 and 10 spent tobacco products. In an embodiment, the receptacle 40 is a molded plastic component with a lid 48 hingedly mounted over an access opening 46 (shown in FIGS. 3 and 9) and has dimensions of about 20 mm to about 50 mm wide, about 10 mm to about 25 mm tall and about 5 mm to about 20 mm deep.

Preferably, the spent product is isolated from the remaining unused tobacco product. The user can empty the receptacle cavity 56 when convenient so that the receptacle 40 can be used again or the entire container can be disposed of. In an embodiment, the receptacle 40 is a permanent part of the lower housing 30.

Figure 3:
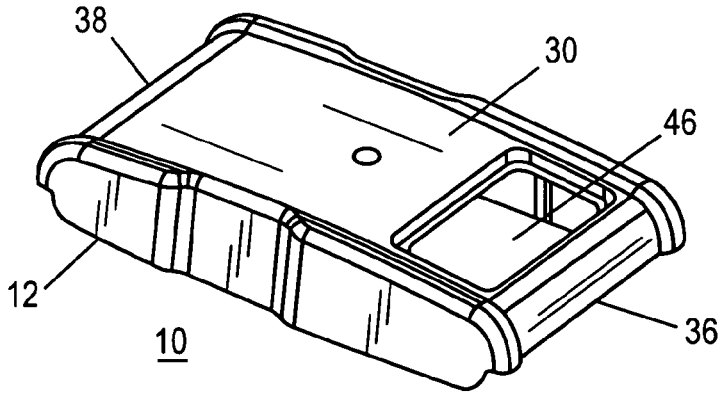
FIG. 3 is a perspective view of the lower housing of the container of FIG. 1 having a recess for holding a receptacle for spent product.

As seen in FIG. 3, the container 10 can include a lower housing 30 having an opening 46 for holding a separate molded receptacle 40 as shown in FIG. 5. The opening 46 communicates with a recess that is sized and configured to receive the receptacle 40. In an embodiment, the removable receptacle 40 is held within the housing by friction, e.g., snap fitting elements which engage edges of the opening 46. In an embodiment, the receptacle 40 is snapped into place within the recess. If desired, the receptacle may include a release mechanism to facilitate removal and cleaning of the receptacle.

Figure 4:
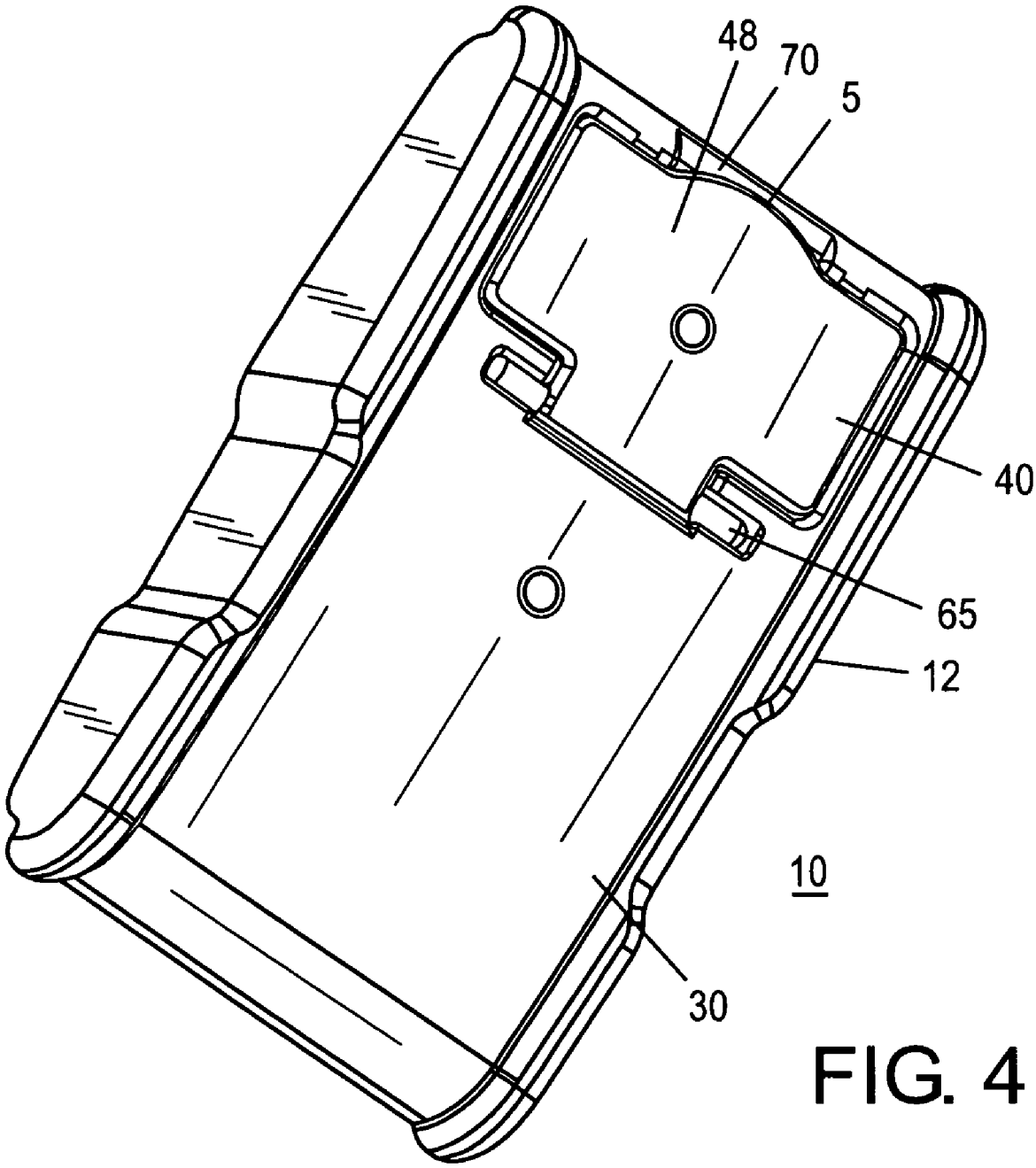
FIG. 4 is a perspective view of an embodiment wherein the receptacle includes a lid hingedly attached to the lower housing.

FIG. 4 is a perspective view of a preferred embodiment of the container 10 wherein the receptacle 40 comprises a recess in the lower housing enclosed by a lid 48 having a lift tab 5 overhanging a depression 70 in the edge of the lower housing 30. The depression 70 allows a user to pull the lift tab 5 to open the lid 48 of the receptacle 40 and access the compartment. Preferably, the lid 48 is attached to the lower housing via a hinge 65. In a preferred embodiment, the lid 48 is held in the open or closed position by friction, a catch mechanism, and/or spring.

In an embodiment, the receptacle 40 as illustrated in FIG. 5, is a separate container defined by sidewalls 58, a lid 48, and a bottom 60. In another embodiment, the lid 48 is hinged via a living hinge to the remainder of the receptacle and opens to reveal a cavity 56, which contains the spent product. In the FIG. 5 embodiment, the receptacle 40 can be separated from the container 10 to empty and/or clean the receptacle 40.

Figure 9:
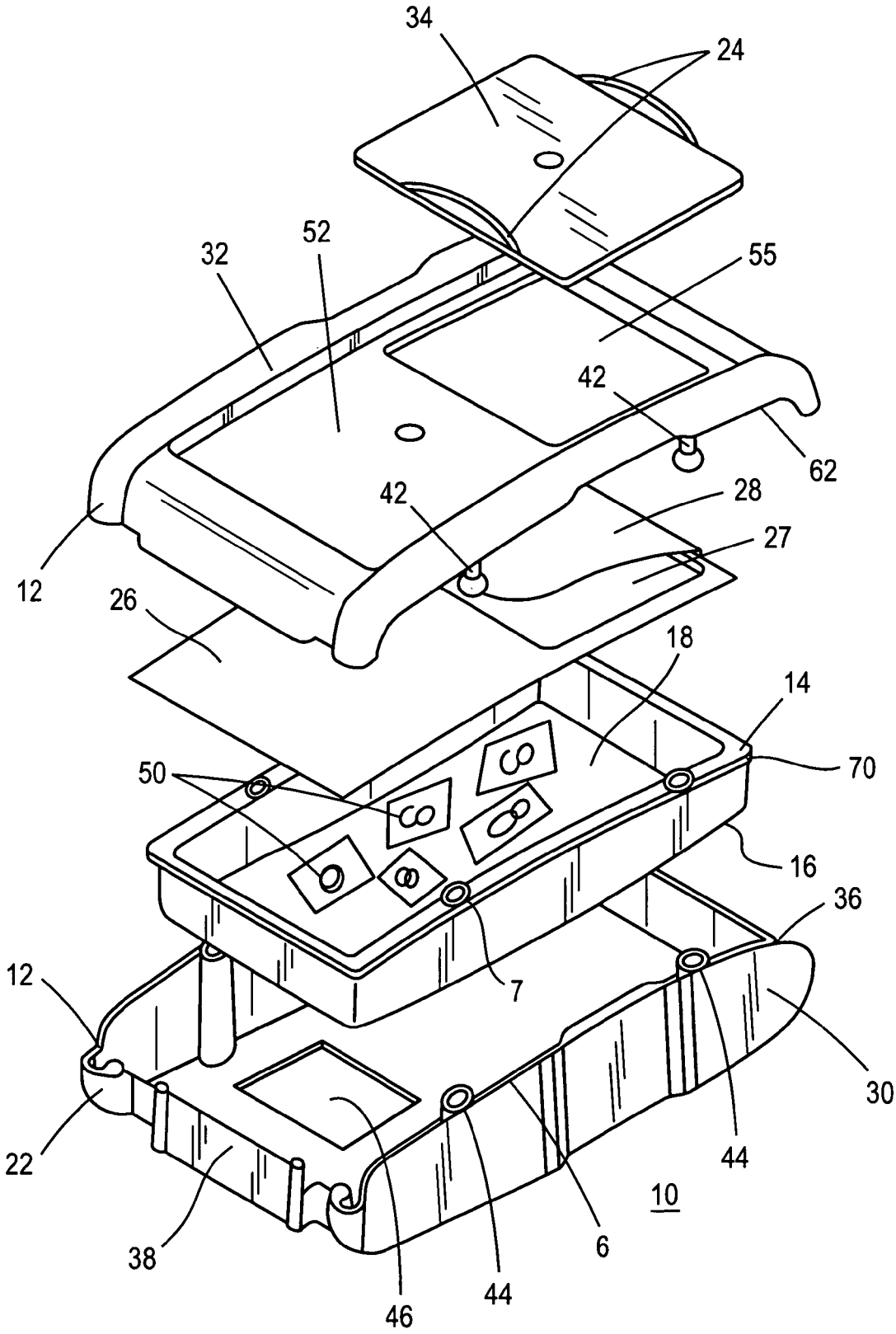
FIG. 9 is an exploded view of a the container of FIG. 1.

As illustrated in FIG. 9, the smokeless tobacco container includes a tray 14 that holds the smokeless tobacco product within the container 10.

In a preferred embodiment, the tray 14 is sealed by a membrane 26, as illustrated in FIG. 6. Preferably, the tray 14 is hermetically sealed to prevent moisture from escaping from the enclosed product. In an embodiment, the membrane 26 may cover just the inner cavity 18, as illustrated in FIG. 9.

In a preferred embodiment, the membrane 26 is a poly-laminated foil membrane when a hermetic seal is required. In another embodiment, the membrane 26 is made of foil. The membrane 26 may be sealed to and/or around the tray 14 using an adhesive, a heat seal, and/or weld.

In a preferred embodiment, the membrane 26 has a pull tab 28 that is pulled by the consumer to break the seal and expose the smokeless tobacco product 50 held within the tray 14. In an embodiment, only one portion of the membrane 26 is opened and removed when the tab 28 is pulled. If desired, a section of material can be torn from the membrane 26 when the tab 28 is pulled to form an access opening into the tray for removal of product. In a preferred embodiment, the membrane 26 is pre-scored such that when the tab 28 is pulled a uniform section of the membrane 26 is removed.

In a preferred embodiment, the membrane 26 covers only the top portion of the tray 14. In another embodiment, the membrane 26 may encapsulate the entire outer surface of the tray.

Preferably, the tray 14 is sized and configured to fit within the outer housing 12. In a preferred embodiment, the tray 14 fits snugly within the outer housing 12 and includes a cavity sized to fit around the receptacle 40.

Also preferably, the tray 14 is contoured to hold a plurality of smokeless tobacco products. In an embodiment, the tray 14 is shaped to have an outside 16 and an inner cavity 18 that is capable of holding products 50 within the tray 14. Preferably, the enclosed product 50 is a smokeless tobacco product such as snus (pouched tobacco products).

The tray 14 may be any shape including rectangular, square, oval, round, octagonal, and other shapes. Preferably, the tray 14 is sized and configured to conform to the shape of the inside of the outer housing 12. Most preferably, the tray 14 has curved sides and bottom to conform to the shape of the outer housing 12 and maximize the available volume for product storage.

Preferably, as illustrated in FIG. 9, the upper housing 32 fits over and around the tray 14 so that the upper housing 32 and the lower housing 30 fasten together to enclose the tray 14 and form the outer housing 12.

In a preferred embodiment, as seen in FIG. 7, the upper housing 32 includes a lid 34 on the top surface 52. The lid 34 is adapted to be slid from a closed position in which it overlies the access opening 55, as shown in FIG. 9, to an open position in which the lid 34 exposes the access opening 55, while still being situated within the footprint of the frame, i.e., the lid 34 is still situated within the boundaries of the upper housing 32.

In another embodiment, the lid 34 is hinged. The lid 34 allows access to an opening in the upper housing through which product is removed from the tray.

In an embodiment, the lid is secured by a securement mechanism which is yieldable to manual pressure.

In a preferred embodiment, as seen in FIGS. 7 and 8, the lid 34 includes at least one transverse thumb ridge 24. Preferably, the lid 34 includes two small ridges 24 located on opposite ends of the lid. In a preferred embodiment, the ridges 24 are located in the middle of each end of the lid. The ridges 24 are slightly raised. Preferably, the ridges 24 are located at a central location, which extends at least 50% of the width of the edges of the lid 34. In a preferred embodiment, the ridges are about 0.5 mm to about 5 mm in width, about 0.5 mm to about 3 mm in height, and about 5 mm to about 25 mm in length. The ridges 24 provide a point of contact on the lid 34 that creates friction with a user's thumb to facilitate opening the lid. Preferably, the ridges 24 are symmetrical too allow easier assembly Preferably, the lid 34 covers an opening 55 that is sized and configured to allow for easy removal of product 50 from the inner cavity 18 of the tray 14 once at least a portion 27 of the membrane 26 has been removed.

In a preferred embodiment, the lid 34 in the upper housing 32 is positioned so that the lid 34 remains within the footprint of the container 10 and opens to reveal the pull tab 28 of the membrane 26. Therefore, the tray is preferably sealed or positioned within the outer housing 12 so that the pull tab 28 will align with the opening 55 once the lid 34 is opened.

In lieu of a sealed tray, the product could simply be placed directly into the compartment formed by the outer housing or in a sealed bag having an openable and/or resealable window.

In a preferred embodiment, the upper housing 32 includes rearwardly projecting pins 42 located on a bottom edge 62 that are receivable in respective sockets 44 disposed in the upper edge 6 of the lower housing 30 thereby securing the front and back parts together. The pins 42 and sockets 44 are located so that the upper housing 32 can be attached to the lower housing 30 in only one position.

In an embodiment, as shown in FIG. 9, to close the outer housing 12 around the tray 14, the pin 42 is inserted into the pin hole 44 to hold the upper housing 32 and the lower housing 30 together. If the edges of the tray 14 overlap the edges of the lower housing 30, pin holes 7 can be formed in the edges of the tray 14 such that the pin 42 on the underside of the upper housing 32 slides through the pin holes 7 in the tray 14 and into the pin holes 44 of the lower housing 30. Preferably, no adhesives are needed to secure the pin 42 within the pin hole 44. However, adhesives may be used if desired and/or the pin or pins can be located on the lower housing and mating hole or holes on the upper housing.

In one embodiment, the upper housing may be secured to the lower housing by a ball and socket type mechanism. In other embodiments, a snap fit connection secures the upper housing to the lower housing.

In an embodiment, the pocket-sized container 10, including the receptacle 40 and tray 14, is an injection molded or thermal formed container. Suitable plastics include, without limitation, polypropylene, polyethylene, polystyrene, nylon, polysulfone, polyester, polyurethane, and combinations thereof. Because some plastics absorb flavors, the preferred plastic is polypropylene because polypropylene will not absorb the flavors of the product while the product is held in the tray.

In other embodiments, the pocket-sized container 10 is cast of metal or formed from wood. Suitable metals include without limitation aluminum.

In an embodiment, the pocket-sized container 10 is about 30 mm to about 60 mm wide, about 70 mm to about 100 mm long, and about 15 mm to about 40 mm deep. In a preferred embodiment, the container 10 fits in the palm of an adult users hand or in a pocket. Most preferably, the size of the tray enclosure 14 is determined based on the amount of product 50 to be enclosed.

Assembly of a container is very simple. The item-containing tray 14 is inserted into the lower housing 30 of the outer housing 12. Next, the upper housing 32 is inserted onto the lower housing 30 and the pins 42 are aligned with their respective sockets 44, thus facilitate mating thereof. The pins 42 and sockets 44 can be sized to provide a snug frictional fit, and/or held together by glue. The lid 34 can be installed on the upper housing 32 either before or after the upper and lower housings are secured together. The lid 34 can be secured in either of two positions, due to the symmetrical configuration thereof as explained earlier.

In use, a consumer grips the underside (back) of the container 10 in the palm of his/her hand, while another digit of the consumer's hand, preferably the thumb, presses against the thumb ridges 24, and slides the lid 34 on the front of the container. Since the lid 34, when fully opened, remains within the footprint of the container 10, it can be easily opened without abutting the consumer's palm as could be the case if the lid were so long that the bottom portion thereof traveled outside of the container's footprint.

The hermetically sealed tray keeps the items in a fresh state until ready for use, and can be conveniently opened, and optionally resealed.

In an embodiment, the container 10 is enclosed in a shrink-wrap enclosure which includes a tear strip along one side for opening the shrink wrap.

However, the particular dimensions and proportions of the container are not critical. The proportions are preferably selected to provide a container which is suitably sized to accommodate the particular items to be packaged therein. Thus, the actual container could be more elongated than shown in the drawings, or the container could be more nearly square, i.e., shorter than shown in the drawings. Preferably, however, the container is sized so it can be conveniently carried in a pocket, and held and opened by one hand of a consumer.

The items can be arranged in various ways. For example, the products could be arranged with the items overlapped or staggered relative to one another. Of course, if the products are small enough, they could be randomly placed in the tray, bag, or loosely held inside the outer housing without a tray or bag.

The container could, of course, be used for a variety of products. One specific product for which the container can be used is commercially available smokeless pouched tobacco. Such tobacco is provided in packets, sometimes known as "snus" and comprise individual packets of tobacco material.

It will be appreciated from the foregoing that there is provided an inexpensive pocket-size container capable of holding multiple items, and capable of being held and opened in one hand of a consumer.

It should be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, exemplary embodiments, as well as alternative embodiments, may be made without departing from the spirit and scope of the articles and methods as set forth in the attached claims.

We claim:

1. A pocket-size hand-held container for containing a supply of consumer items comprising:

an outer housing including an upper housing and a lower housing;

a first lid attached to the upper housing to be slid linearly in the longitudinal direction between closed and open positions, wherein:

in its fully closed position, the first lid overlying an access opening, and in its fully open position, the first lid exposing the access opening and situated within the footprint of the container;

a tray received within the outer housing, the tray including a storage compartment formed by a bottom wall and sidewalls of the tray; and a receptacle located at least partially within said outer housing, the receptacle including a second lid.

2. The pocket-size hand-held container for containing a supply of consumer items of claim 1, wherein said first lid includes at least one raised thumb ridge so as to facilitate opening and closing of said first lid.

3. The pocket-size hand-held container for containing a supply of consumer items of claim 2, wherein said at least one raised thumb ridge has dimensions of about 0.5 mm to about 5 mm in width, about 0.5 mm to about 3 mm in height, and about 5 mm to about 25 mm in length.

4. The pocket-size hand-held container for containing a supply of consumer items of claim 1, wherein said second lid is hingedly attached to said receptacle.

5. The pocket-size hand-held container for containing a supply of consumer items of claim 1, wherein said receptacle is defined by a recess within said outer housing.

6. The pocket-size hand-held container for containing a supply of consumer items of claim 1, wherein said receptacle is a self contained component which is snap fitted into an opening in said outer housing.

7. The pocket-size hand-held container for containing a supply of consumer items of claim 1, wherein said receptacle is about 20 mm to about 50 mm wide, about 10 mm to about 25 mm tall and about 5 mm to about 20 mm deep.

8. The pocket-size hand-held container for containing a supply of consumer items of claim 1, wherein said tray contains smokeless tobacco products and said receptacle is large enough to hold about 1 to about 12 spent smokeless tobacco products.

9. The pocket-size hand-held container for containing a supply of consumer items of claim 1, wherein the tray is hermetically sealed by a membrane.

10. The pocket-size hand-held container for containing a supply of consumer items of claim 9, wherein said membrane includes a manually openable window disposed beneath the access opening.

11. The pocket-size hand-held container for containing a supply of consumer items of claim 10, wherein the openable window is resealable.

12. The pocket-size hand-held container for containing a supply of consumer items of claim 9, wherein said membrane is a poly-laminated membrane.

13. The pocket-size hand-held container for containing a supply of consumer items of claim 1, wherein said tray contains a plurality of smokeless tobacco pouch products.

14. The pocket-size hand-held container for containing a supply of consumer items of claim 1, wherein said container is of rigid plastic and wherein said container is injection molded.

15. The pocket-size hand-held container for containing a supply of consumer items of claim 14, wherein said container is injection molded of a material selected from the group consisting of polypropylene, polyethylene, polystyrene, nylon, polysulfone, polyester, polyurethane, and combinations thereof.

16. The pocket-size hand-held container for containing a supply of consumer items of claim 1, wherein said container is about 30 mm to about 60 mm wide, about 70 mm to about 100 mm long, and about 15 mm to about 40 mm deep.

17. The pocket-size hand-held container for containing a supply of consumer items of claim 1, wherein said upper housing includes at least one pin and said lower housing includes at least one pin hole receiving said at least one pin so as to secure said upper housing to said lower housing.

* * * * *